United States Patent [19]

Kamstrup-Larsen

[11] 4,428,991

[45] Jan. 31, 1984

[54] PLATE-SHAPED INSULATION MEMBER AND A METHOD FOR MANUFACTURING SUCH A MEMBER

[75] Inventor: Jorgen Kamstrup-Larsen, Allerod, Denmark

[73] Assignee: Superfos Glasuld A/S, Vedbaek, Denmark

[21] Appl. No.: 19,145

[22] Filed: Mar. 9, 1979

[30] Foreign Application Priority Data

Mar. 15, 1978 [DK] Denmark ..... 1172/78
Sep. 13, 1978 [DK] Denmark ..... 4032/78

[51] Int. Cl.[3] ..... B32B 3/10; B32B 31/00; B32B 5/12; B32B 3/28

[52] U.S. Cl. ..... 428/44; 52/384; 52/586; 138/120; 138/128; 156/264; 156/304.3; 428/52; 428/58; 428/114; 428/167

[58] Field of Search ..... 428/173, 114, 167, 58, 428/169, 44, 52; 156/264, 304.3, 304.4, 304.5; 264/248, 249, 251, 258; 52/586, 582, 384

[56] References Cited

U.S. PATENT DOCUMENTS

| | | | |
|---|---|---|---|
| 2,045,382 | 6/1936 | Elmendorf | 52/586 |
| 2,661,511 | 12/1953 | Weyerhauser | 52/586 |
| 3,030,246 | 4/1962 | Westlake, Jr. | 156/304.3 |
| 3,342,665 | 9/1967 | Shannon | 428/428 |
| 3,353,315 | 11/1967 | Barker | 52/586 |
| 3,661,669 | 5/1972 | Cairns | 156/304.4 |
| 3,791,912 | 2/1974 | Allard | 428/167 |
| 3,928,691 | 12/1975 | Knudson | 428/61 |
| 3,969,868 | 7/1976 | Bainter et al. | 428/167 |
| 4,025,680 | 5/1977 | Botsolar et al. | 428/114 |
| 4,044,182 | 8/1977 | Aizana | 428/58 |
| 4,205,105 | 5/1980 | Blundell | 428/36 |
| 4,348,441 | 9/1982 | Kato | 428/58 |

FOREIGN PATENT DOCUMENTS

| | | |
|---|---|---|
| 504323 | 7/1930 | Fed. Rep. of Germany . |
| 1047702 | 12/1958 | Fed. Rep. of Germany . |
| 7338109 | 3/1974 | Fed. Rep. of Germany . |
| 2503429 | 7/1976 | Fed. Rep. of Germany . |
| 2717423 | 10/1977 | Fed. Rep. of Germany . |
| 6807626 | 12/1968 | Netherlands . |
| 69150 | 4/1945 | Norway . |
| 185511 | 10/1963 | Sweden . |
| 225579 | 3/1969 | Sweden . |
| 401944 | 6/1978 | Sweden . |
| 1054088 | 1/1967 | United Kingdom . |
| 1403322 | 8/1975 | United Kingdom . |
| 1530051 | 10/1978 | United Kingdom . |

*Primary Examiner*—William R. Dixon, Jr.
*Attorney, Agent, or Firm*—Stevens, Davis, Miller & Mosher

[57] ABSTRACT

In a plate-shaped insulation member consisting of parallel mineral wool strips positioned side by side with the fiber planes normal to the main surfaces of said members the strips are joined together by connecting means laid down in parallel tracks extending transverse to said strips and having a small depth relative to the thickness of the strips. The connecting means may consist of strings laid down in tracks either in one main surface only for production of flexible insulation mats or in both main surfaces for production of rigid formstable insulation plates. The latter may also be produced by connecting means in the form of relatively thin strips of corrugated wall board, for example, laid down in said tracks in an upstanding position.

12 Claims, 10 Drawing Figures

FIG. 4
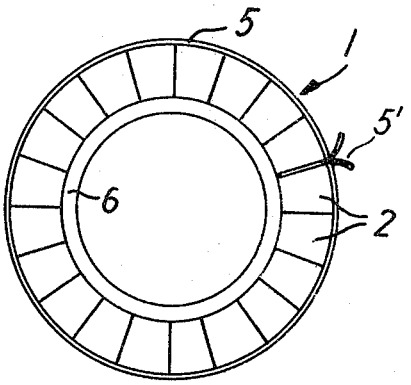
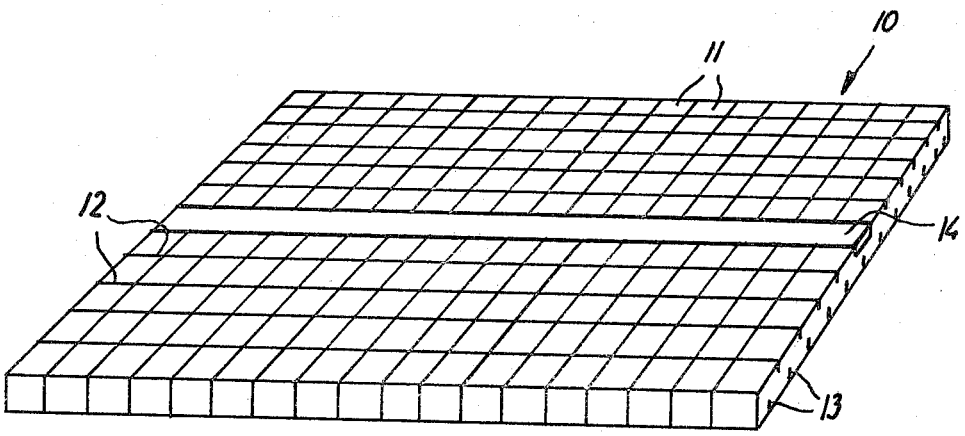
FIG. 7
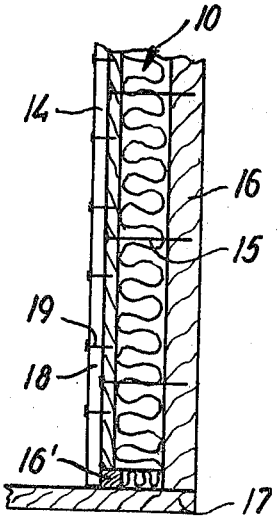
FIG. 8

PLATE-SHAPED INSULATION MEMBER AND A METHOD FOR MANUFACTURING SUCH A MEMBER

The invention relates to plate-shaped insulation members of the kind comprising a series of parallel mineral wool strips positioned side by side with their fiber planes turned to be normal to the main surface of the member, said strips being joined together by connecting means at one of said main surfaces.

BACKGROUND OF THE INVENTION

It is known to produce rigid insulation plates allowing a considerably increased tension or pressure load compared to usual mineral wool mats in which the fibers extend in planes parallel to the main surfaces by using so-called strip insulation members of the above-mentioned kind in which the mineral wool strips are joined together at one main surface only by means of a plate of a hard material such as masonite or other pressed fiber board adhesively bonded to said main surface throughout the area thereof, said plate functioning, in addition as a pressure distribution plate.

These known rigid strip insulation plates have a considerably increased weight relative to plain mineral wool mats and their properties with respect to bending rigidity and breaking strength are limited to those of the hard connecting plate, the thickness of which must be small due to weight considerations. Moreover, since it is important that the strips which are secured to the hard plate only, are kept tightly together and not separated on the underside during manipulation of the insulation plates, these circumstances have resulted in that the known strip insulation plates have been manufactured in rather small dimensions only, up to about 60×90 cms., so that covering a greater surface area with such plates has required a great number of connecting points.

Since it is an advantage for the heat insulation properties that the mineral wool strips are pressed together before connection with the pressure distribution plate, the lack of connecting means at the underside may result in expansion of the strips, whereby the entire plate may bend.

Attempts to increase the bending rigidity and form stability of the known strip insulation plates by adhesively bonding hard plates to both main surfaces of the strip plate has not resulted in any improvement with respect to manipulation due to the increased weight, and has moreover led to increasing manufacturing costs.

For the production of pipe insulation mats it is also known to join mineral wool strips together by a flexible covering layer, made e.g. from paper, at one main surface.

SUMMARY OF THE INVENTION

It is the object of the invention to provide a new construction of insulation members of the kind referred to for use as flexible insulation mats as well as rigid, formstable insulation plates, in both cases with considerably improved load resisting properties relative to the known strip insulation members.

According to the invention there is provided an insulation member comprising a plate-shaped arrangement of a series of parallel strips of mineral wool extending side by side with their fiber planes substantially normal to a pair of opposed parallel main surfaces of the plate-shaped arrangement, said strips being joined together at least at one of said main surfaces by connecting means laid down in parallel tracks extending transverse to said strips and having a small depth relative to the thickness of the strips.

Thereby, dependant on the construction of the connecting means and the arrangement thereof at one or both of said main surfaces a possibility is obtained for producing formstable plates as well as flexible mats for use e.g. by pipe insulation.

Preferably, the connecting means are made of a material, the workability properties of which corresponds to those of the mineral wool strips. Thereby, cutting of the final member whether in the form of plates or mats may be performed in the same manner as for usual insulation mats by means of a knife, in contradiction to the known rigid strip insulation plates which may be cut by sawing only.

When using connecting means constituted by flexible elongate members adhesively bonded to the bottom of each of said tracks throughout the extension thereof, there may be obtained when arranging such members in tracks in one main surface only, a flexible mat suitable for pipe insulation.

Such a mat is arranged on the bended or curved support, e.g. of a pipe, with the main surface, at which the connecting means are arranged, positioned at the greatest radius of curvation, i.e. in case of a convex curved surface at the greatest separation therefrom, and in case of a concave curved surface as close as possible thereto. Thereby, the strips will be compressed at the opposite side of the mat where no connecting means are present and at which the radius of curvature is smaller, which will allow insulation with greater mat thickness than in case of the above-mentioned strip insulation mats in which the strips are joined together by means of a covering layer, such as paper, at one main surface, since the connecting means used in accordance with the invention may have a considerably increased tensile strength and extend beyond the sides of the mat for the purpose of binding or ligature.

Connecting means of this kind may consist, for example of strings.

However, by using such connecting means there may also be obtained, in addition to flexible mats, formstable rigid insulation plates if such elongate members such as strings are laid down in tracks in both main surfaces of the insulation member, since in this case the connecting means being flexible per se will in combination with a slight transverse compression of the strips prevent mutual displacement or separation of the strips at both main surfaces.

However, insulation members according to the invention may also be formed as formstable rigid plates by using connecting means constituted by relatively thin strips arranged in an upstanding position in each of said tracks.

In this case a considerably improved bending rigidity relative to known rigid strip insulation plates is obtained already by connecting means arranged in tracks in one main surface only.

It is preferred, however, that also such connecting means having the form of strips are laid down in tracks in both of said opposed main surfaces, whereby there is obtained a plate which is easy to handle and has a low weight and a great bending rigidity and form stability whether the plate is composed of longitudinal or transverse mineral wool strips.

A high rigidity may be obtained by connecting strips having a small thickness and width if the strips are made of a corrugated material with the corrugations extending transversely to the longitudinal direction of the strips. A suitable and cheap material fulfilling, in addition, the workability requirement, is corrugated wall board.

However, compared with such connecting strips the manufacture of formstable insulation plates will be somewhat simpler and cheaper when using connection means in the form of strings which are easier to handle and store, and the positioning of which in the tracks is simpler due to the flexibility of a string in contradistinction to strips which should be arranged in an upstanding position.

Whether connecting means are used having the form of strings or strips arranged in an upstanding position, insulation members according to the invention constructed as formstable plates will show a considerably improved bending rigidity and form stability relative to known strip insulation plates without any significant weight increase relative to usual mineral wool mats, so that plates which are easy to handle may be produced in considerably greater dimensions than hitherto possible, e.g. 120×240 cms., and at a lower price due to a considerably smaller consumption of adhesive for the connection of strips and connecting means.

As a matter of fact, in insulation members according to the invention adhesive should only be applied to the tracks for the connecting means so that the consumption of adhesive, whether the connecting means are strings or strips, will be considerably smaller compared with known strip insulation plates or mats. In practice it has proved to be quite sufficient if the connecting means are adhesively bonded to the bottom of the tracks.

A formstable strip insulation plate according to the invention will be particularly suitable for the insulation of floors or walls in cases where a subsequent lining should be applied to the accessible side of the insulation plate, if a nail receiving bar is arranged in an elongate cut-out in one of said main surfaces. Such a cut-out will not interfere with the connecting means if the latter are positioned at a greater depth than the bottom of the cut-out. Therefore, a nail receiving may extend in any direction relative to the mineral wool strips. Such a bar which may be made of plywood or another nail receiving material may be used for nailing both when securing the insulation plate to the supporting building structure and when arranging lining plates on the accessible side of the insulation plate.

Such a nail receiving bar may be used in case of a plate connected by means of strings as well as a plate connected by strip-shaped connecting means.

Due to their excellent bending rigidity and form stability insulation members according to the invention constructed as rigid insulation plates are suitable for storage as base or master plates for a number of different applications. If a pressure distribution plate of a hard material, which plate may in itself have a relatively small thickness and weight, is arranged on one side of the insulation plate, a tread proof plate is obtained which is directly applicable as a support for roofing materials such as roofing felt or floor material in the form of moulded materials, parquet or other known floor materials. Moreover, rigid insulating plates according to the invention are suitable for production of highly insulating wall elements when provided with hard plates, e.g. of plywood, on both main surfaces.

Furthermore, according to the invention there is provided a method of manufacturing plate-shaped insulation members as mentioned in the foregoing, comprising the steps of cutting a series of strips from one side of a stack of aligned superimposed substantially plate-shaped mineral wool members in a cutting direction transverse to the fiber planes in said members, turning said series of strips through an angle of 90° to be positioned on a flat, substantially horizontal conveyor surface with said fiber planes normal to said conveyor surface and the longitudinal direction of the strips pendicular to a transport direction of said conveyor surface, and performing during movement of said strip series in said transport direction the successive operations of cutting a number of tracks parallel to the transport direction in at least one of the main surfaces of said strip series parallel to said conveyor surface, positioning an adhesive along the bottom of each track and laying connecting means down in each track to be bonded to the bottom thereof by means of said adhesive.

BRIEF DESCRIPTION OF THE DRAWINGS

In the following the invention will be further explained with reference to the accompanying drawings, in which

FIG. 4 shows a mat-shaped insulation member as shown in FIG. 1 as a pipe insulation;

FIG. 7 a further development of the embodiments shown in FIGS. 1 and 5 to be applied as a formstable insulation plate for wall or floor insulation;

FIG 8 a sectional view of a wall insulation built up with an insulation plate as shown in FIG. 7.

DETAILED DESCRIPTION

Figure 1:
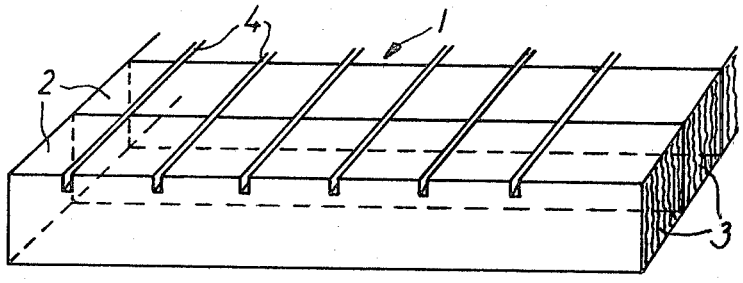
FIG. 1 is a perspective view of an embodiment of an insulation member according to the invention.

FIG. 1 shows a portion of a plate-shaped insulation member 1 composed of strips 2 which have been cut transverse to the fiber planes from mineral wool mats and subsequently turned 90° around their longitudinal axes and arranged side by side so that the fiber planes as indicated at 3 are normal to the main surfaces of insulation member 1.

Figure 2:
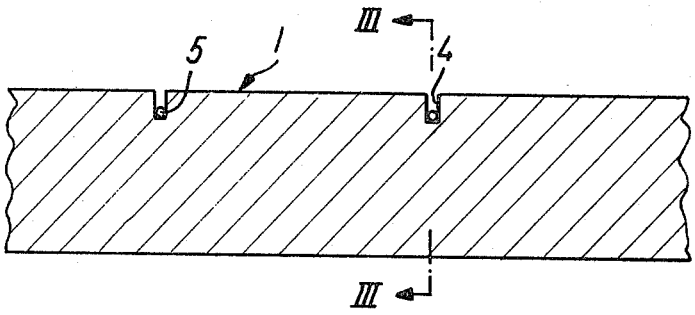
FIGS. 2 and 3 are sectional views illustrating in more detail the connecting means in the embodiment shown in FIG. 1.
Figure 3:
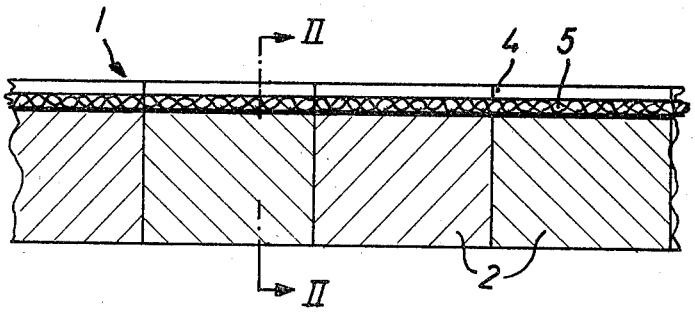

In the embodiment shown a number of parallel tracks 4 are formed in one main surface of insulation member 1 transverse to the longitudinal direction of strips 2, in which tracks continuous connecting means 5 are laid down as shown in the sectional views in FIGS. 2 and 3 for joining the strips 2 together. The depth of the tracks is small relative to the plate thickness, e.g. 6 to 15 mms. for a plate thickness of 10 to 15 cms., so that the tracks will not reduce the insulating properties. In the embodiment shown the connecting means 5 consist of strings whereby a simple and economic production is obtained.

However, the connecting means may also consist of other forms of flexible elongate members having substantially circular cross section which are suitable for being adhesively bonded to the bottom of the tracks 4, and, as explained in the following, of strip-shaped members arranged in an upstanding position in the tracks.

An insulation member as shown in FIGS. 1–3, where the connecting means exist only at one main surface of the member, is suitable as flexible insulation mats for use e.g. in pipe insulation, such as illustrated in FIG. 4. In said figure is shown a flexible strip insulation mat 1, as illustrated in FIGS. 1–3, arranged round a pipe 6 to be insulated, in such a manner that the connecting means laid down in the tracks 4, e.g. strings 5, are positioned at the greatest radius of curvation, i.e. at the greatest distance from the pipe 6. In wrapping up the pipe a compression of the strips 2 is obtained on the opposite side of the insulation mat 1 contacting the pipe 6. As already mentioned the possibility of a greater insulation thickness than in known pipe insulation with strip mats is hereby obtained, since the strings 5 have a considerable tensible strength and may, moreover, be extended beyond the side of the insulation mat for binding together the string ends as shown at 5', or the provision of a ligature.

However, by positioning connecting means in the form of flexible elongate members such as strings in parallel tracks on both sides of the insulation member in connection with a slight transverse compression of the strips there may also be obtained a formstable strip insulation plate which is bending resistant in all directions.

In principle, a formstable strip insulation plate having flexible connecting means such as strings will have an appearence as shown in FIGS. 1 to 3, strings being laid down, however, in tracks in both opposite surfaces of the insulation member, and is therefore not further illustrated.

Figure 5:
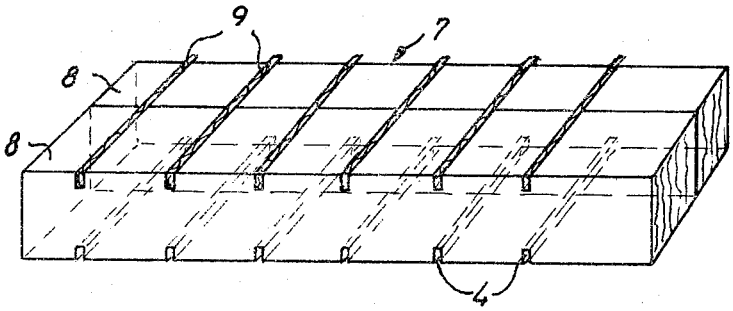
FIG. 5 is a perspective view of another embodiment of a strip insulation member according to the invention as a formstable insulation plate.

Another construction of the insulation member according to the invention as a formstable plate is shown in FIG. 5 in which a number of parallel tracks are formed in opposite surfaces of a plate 7 transverse to the longitudinal direction of strips 8, in which tracks continuous connecting strips 4 are laid down in an upstanding position for provision of a fixed connection of the strips 8. The depth of the tracks is small relative to the plate thickness, e.g. a depth of 10 to 15 mms for a plate thickness of 10 to 15 cms, so that the insulation is not reduced to any noticeable degree due to so-called cold conducting bridges between opposite tracks, and the strips 9 have a width corresponding thereto, so that they will not project from the surfaces of the plate 7. The strips 9 are secured in the tracks by means of an adhesive which is injected to the bottom of the tracks.

Whether the strips are connected by strings or strips formstable plates made from insulation members according to the invention will have a natural bending rigidity in the longitudinal direction of the strips due to the rigidity of the strips transverse to the fiber plates, whereas the bending rigidity transverse to the strips 2 or 8 is secured by the strings 5 or the strips 9 taking up the forces which will occur in case of a bending action of the plate 1 or 7 in this direction.

Thereby, there is obtained a plate which is bending resistant in all directions and in which no possibility exists for separation of the strips to get out of contact with each other.

Particularly, in the embodiment shown in FIG. 5 it will often be possible in case of a plate composed of transverse strips at normally occuring plate thicknesses to obtain a sufficient bending rigidity by laying down the strips 9 in tracks in one plate surface only.

In case of double-sided connection by means of strings or strips, the tracks in the two plate surfaces may at normally occuring plate thicknesses be positioned opposite each other as shown in FIG. 5 without any noticeable reduction of the insulation properties due to cold conducting bridges. In case of plates having a reduced thickness it is preferred, however, in order to maintain a good insulation property to offset the tracks in the two opposite surfaces of the plate relative to each other.

Figure 6:
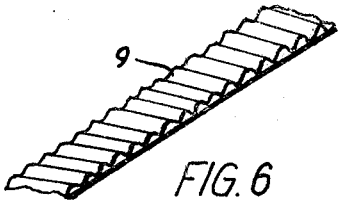
FIG. 6 is a perspective view of a connection strip used in the embodiment shown in FIG. 5.

As a suitable and cheap material for the connecting strips 9 in the embodiment shown in FIG. 5 corrugated wall board is preferred, in which the corrugations are transverse to the longitudinal direction of the strips such as shown in FIG. 6. When laid down in an upstanding position transverse to the mineral wool strips, strips of this kind made of a material which is flexible per se will have a great bending rigidity in the longitudinal direction. However, other corrugated or non-corrugated materials may also be applied, whereby in order to maintain good insulation properties a material having a poor heat conduction and with a view to cutting the finished plate to dimensions a material should be preferred which may be cut in the same manner as mineral wool by means of a knife.

Whether connecting means are used in the form of strings or strips the mutual separation of the tracks in the plate 1 will depend of the plate thickness and when using strips as shown in FIG. 5 whether tracks are provided in one surface only or in both surfaces of the plate. In case of relatively thin plates the tracks will have to be positioned at a smaller separation than in case of thicker plates, and, correspondingly the track separation in the embodiment shown in FIG. 5 must be smaller when tracks are provided in one side of the plate only than in the case of double-sided connection. At a plate thickness of 10 to 15 cms and double-sided connection a track separation of about 20 cms will normally be suitable.

In FIG. 7 a particular embodiment of a formstable plate is shown which is particularly suitable for use as a wall or floor insulation plate. The figure shows a rectangular plate 10 with strips 11 extending in the width direction and longitudinal tracks 12 and 13, respectively, in both plate surfaces, which tracks at small plate thicknesses may be offset to each other as mentioned in the foregoing in order to reduce the risk of cold conducting bridges. In the tracks 12 and 13 connecting means either in the form of flexible members such as strings or in the form of strips such as shown in FIG. 5 may be laid down. However, these connecting means are not shown in FIG. 7.

In this example, a bar 14 of a material suitable to receive nails, such as plywood, is furthermore positioned in a longitudinal cut-out transverse to strips 11 in one surface of the plate 10 to be used when nailing the insulation plate proper to a support and when arranging a further lining on the accessible side of the insulation plate 10 on which the nail receiving bar 14 is positioned.

Since the cut-out has only a relatively small depth and the connecting means may be positioned at a greater depth in the tracks, the nail receiving bar 14 may extend, however, with any arbitrary direction relative to the strips without interrupting the connecting means. Particularly, the nail receiving bar may also extend in the longitudinal direction of the strips which as an extreme case opens the possibility of producing an insulation member composed of relatively few strips and acting as a bearing beam, whereby in case of a wall insulation the spaces between such insulation members may be filled out with a soft insulation material.

FIG. 8 shows a wall insulation carried out by means of an insulation member as shown in FIG. 7. The insulation plate 10 is secured to an outer wall member 16 by means of relatively long nails 15, which are hammered through the nail receiving bar 14, and the lower edge of the insulation plate rests on a lath 16' which is nailed to a floor 17. An inner lining 18 e.g. in the form of a plaster plate or a veneer sheet is subsequently secured to the accessible side of the insulation plate 10 by means of nails 19 hammered into the nail receiving bar 14, whereby the lath 16' forms an abutment for the inner lining 18 at the floor 17. In this manner a very simple installation of insulation plates is achieved since no lath framework is required, and thereby, insulation plates as shown in FIG. 7 will be particularly suitable for post insulation purposes in which it is otherwise required, particularly in case of great insulation thicknesses, to use a greatlath framework resulting in itself in considerable expenses.

Figure 9:
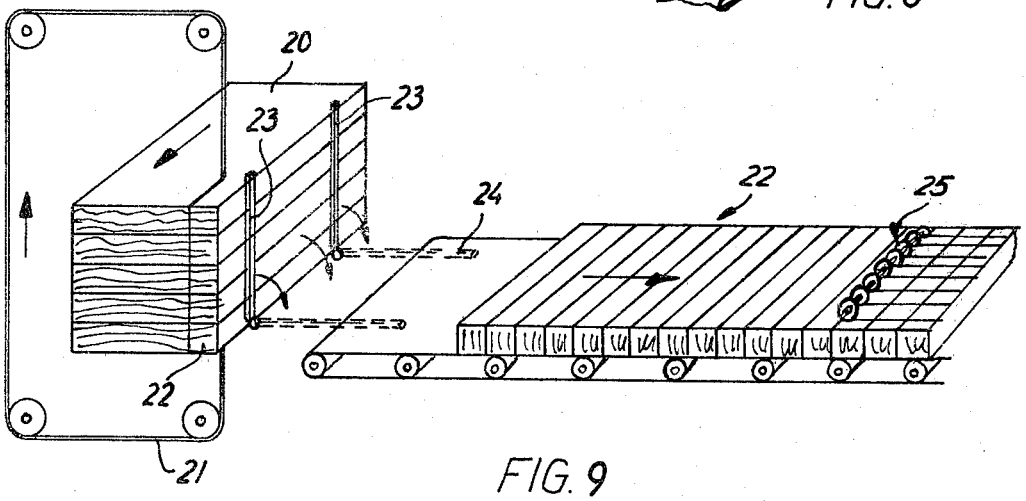
FIGS. 9 and 10 illustrate the method according to the invention by means of an automatic system for the production of strip insulation members.
Figure 10:
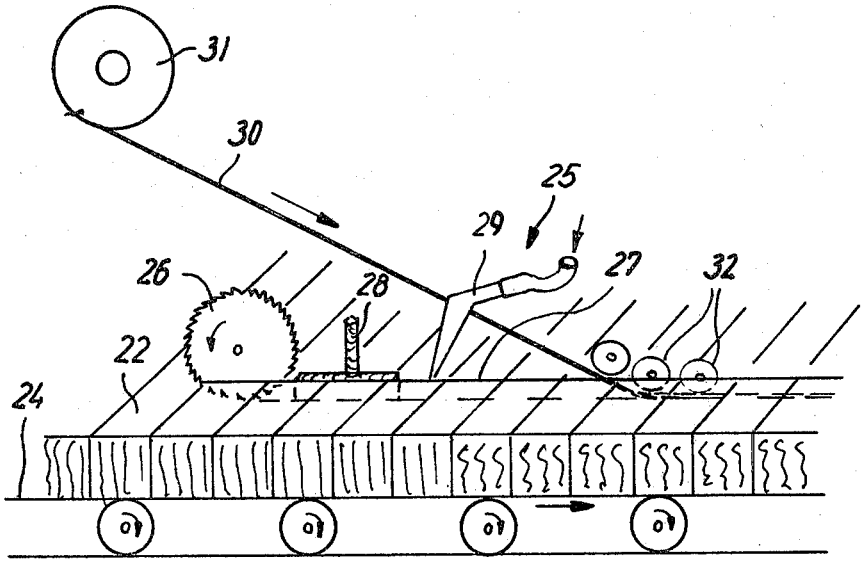

FIGS. 9 and 10 shows schematically portions of a plant for manufacturing strip insulation members as shown in FIG. 1 in series production.

From a stack of superimposed similar mineral wool plates 20 in which the fiber planes are parallel to the main surfaces a series of strips 22 are cut transverse to the fiber planes by means of a band saw 21. After cutting the strip series 22 are turned through an angle of 90° by means of pivoted arms 23 and laid down on a band conveyor 24 with the longitudinal direction of the strips transverse to the transport direction thereof. By means of the band conveyor 24 the strip series 22 is moved to join one or more corresponding strip series earlier positioned on the band conveyor.

Thereby, the fiber planes in the individual strips will now be substantially perpendicular to the transport plane for the band conveyor 24.

The band conveyor 24 transports the adjoined strip series 22 to a number of working stations 25 arranged in parallel transverse to the transport direction, each of said working stations serving for positioning connecting means in the upper and/or lower surfaces of the strips.

FIG. 10 shows in further details a single working station 25 as provided for each of the tracks to be formed in the strip series 22. The working station shown comprises a circular saw 26 which cuts a track 27 having the desired depth, e.g. 5 to 15 mms in the upper side of the strips series 22. Subsequent to this track cutting the strip series 22 is guided in the transverse direction by means of a guide member 28 to align the tracks 27 formed in the individual strips. After the guide member 28 an injection device 29 is arranged by means of which an adhesive is injected down to the bottom of the track 27.

The adhesive to be used may for example be a suitable fast hardening or solidifying glue. Preferably, an adhesive is used which is applied in a warm condition at a temperature of e.g. 200° C. and solidifies immediately by cooling to a temperature of e.g. 100° to 130° C. Such an adhesive may for example be a glue of the so-called "hot melt" type or warm asphalt.

After the injection of adhesive into the track 27 connection means such as a string 30, which is supplied continuously from a roll 31 is laid down in the track 27, and positioned by means of discs 32 having a width corresponding to the track 27 so that the string 30 is carried to the bottom of the track 27.

In order to compress the strips 2 in the strip series 22 during provision of the connecting means which will be particularly advantageous in case of connecting means in the form of strings for obtaining a tensile bias, the band conveyor 24 as shown in FIG. 9 may be divided into two aligned parts, one of which extending to some distance in front of the working station 25 runs at a greater speed than the other part extending from the working stations 25 and in the direction to the right in FIG. 9.

When using connecting means in the form of strips instead of strings, a strip of corrugated wall board as shown in FIG. 6, which is continuously supplied from a roll, is arranged in an upstanding position in each track 27 and positioned by means of rollers so that the outer edge of such a strip is aligned with or countersunk relative to the upper and/or lower side of the mineral wool strip.

Subsequent to the arrangement of the connecting means in the form o strings or strips and solidification or hardening of the adhesive, insulation plates as shown in FIG. 1 or 5 may be cut into desired lengths at the end of the band conveyor 24 in a manner not shown.

What we claim is:

1. An insulation member shaped as a body having planar first and second major surfaces generally parallel to each other, the body comprising a plurality of rectangular blocks, each block having a plurality of generally mutually parallel relatively short lengths of mineral wool, said blocks being in contiguous abutting relationship along their long edges without any adhesive binder between adjacent blocks, said mineral wool fiber planes extending between said first and second major surfaces and substantially perpendicular to those major surfaces;

said major surfaces being open to expose the mineral wool in said blocks without any covering over either major surface; said body having a plurality of closed spaces therein and being free of any adhesive binder mixed throughout the mass of fibers;

a plurality of generally parallel grooves of narrow width and shallow depth relative to the thickness of said body formed on at least one major surface and extending transverse to the longitudinal direction of the mineral wool strips;

reinforcing means in said grooves comprising elongate flexible strips or string-like connecting means secured therein by an adhesive bond for joining together said blocks without the need for any further connecting means at said major surfaces or on the abutting sides of the individual blocks to hold the body together for handling.

2. An insulation member shaped as a body having planar first and second major surfaces generally parallel to each other, the body comprising:

a plurality of generally mutually parallel strips, each strip being made up of relatively short fiber lengths of mineral wool, each strip extending between said first and second major surfaces with said lengths of mineral wool extending in planes substantially perpendicular to those major surfaces;

said major surfaces being open to expose the mineral wool in said strips without any covering over either major surface; said body having a plurality of closed spaces therein and being free of any adhesive or binder mixed throughout the mass of fibers;

a plurality of generally parallel grooves of narrow width and shallow depth relative to the thickness of said body formed on both major surfaces extending transverse to the longitudinal direction of the mineral wool strips;

reinforcing means in said grooves comprising elongate flexible string- or wire-like connecting means secured therein by an adhesive bond for joining together said mineral wool strips without the need for any further connecting means at said major surfaces or on the abutting side of the individual mineral wool strips to hold the body together for handling.

3. An insulation member as claimed in claim 2 wherein the grooves in said major surfaces are offset relative to each other.

4. An insulation member as claimed in claim 2, wherein a nail receiving bar is arranged in an elongate cut-out in one of said major surfaces.

5. An insulation member shaped as a body having planar first and second major surfaces generally parallel to each other, the body comprising:

a plurality of generally mutually parallel strips, each strip being made up of relatively short fiber lengths of mineral wool, each strip extending between said first and second major surfaces with said lengths of mineral wool extending in planes substantially perpendicular to those major surfaces;

said major surfaces being open to expose the mineral wool in said strips without any covering over either major surface; said body having a plurality of closed spaces therein and being free of any adhesive or binder mixed throughout the mass of fibers;

a plurality of generally parallel grooves to narrow width and shallow depth relative to the thickness of said body formed on at least one major surface extending transverse to the longitudinal direction of the mineral wool strips;

reinforcing means in said grooves comprising elongate relatively thin strips arranged in an upstanding position in each of said grooves and by an adhesive bond for joining together said mineral wool strips without the need for any further connecting means at said major surfaces or on the abutting sides of the individual mineral wool strips to hold the body together for handling.

6. An insulation member as claimed in claim 5, wherein said strips are made of a corrugated material with the corrugation extending transversely to the longitudinal direction of the strips.

7. An insulation member as claimed in claim 6, wherein said material is corrugated wall board.

8. An insulation member as claimed in claim 5, wherein said grooves are provided in both major surfaces.

9. An insulation member as claimed in claim 8, wherein the grooves in said major surfaces are offset relative to each other.

10. An insulation member as claimed in claim 5, wherein a nail receiving bar is arranged in an elongate cut-out in one of said major surfaces.

11. An insulation member shaped as a body having first and second major surfaces generally parallel to each other, the body comprising:

a plurality of generally mutually parallel strips, each strip being made up of relatively short fiber lengths of mineral wool, each strip extending between said first and second major surfaces with said fiber lengths of mineral wool extending in planes substantially perpendicular to those major surfaces;

said major surfaces being open to expose the mineral wool in said strips without any covering over either major surface; said body having a plurality of closed spaces therein and being free of any adhesive or binder mixed throughout the mass of fibers;

a plurality of generally parallel grooves of narrow width and shallow depth relative to the thickness of said body formed on one major surface extending transverse to the longitudinal direction of the mineral wool strips;

flexible string- or wire-like connecting means arranged in said grooves in only one of said major surfaces and secured therein by an adhesive hood for joining together said mineral wool strips without the need for any further connecting means at said major surfaces or on the abutting sides of the individual mineral wool strips to hold the body together for handling, whereby to allow bending of the insulation member for the insulation of pipes with said one major surface constituting an exterior side of the pipe insulation.

12. An insulation member as claimed in claim 11, wherein said string- or wire-like connecting means project in the longitudinal direction outside the ends the insulation member to be tied with each other after arrangement on the insulation member on a pipe to be insulated.

* * * * *

UNITED STATES PATENT AND TRADEMARK OFFICE

CERTIFICATE OF CORRECTION

PATENT NO. : 4,428,991
DATED : January 31, 1984
INVENTOR(S) : Jorgen KAMPSTRUP-LARSEN, et al It is certified that error appears in the above-identified patent and that said Letters Patent is hereby corrected as shown below:

On the first page (title page)

Item "[75] Inventor:" should read: -- Jorgen Kamstrup-Larsen, Allerod; Knud-Erik Karas-Jensen, Dragor, Denmark.--

Under "References Cited" the list of "U.S. Patent Documents" should include as its first item:
--616,479 12/1898 Martin 52/586.--

"Foreign Patent Documents" should include as its third item:
-- 1,459,973 11/1968 Fed. Rep. of Germany --.

Signed and Sealed this

*Twenty-third* Day of *October 1984*

[SEAL]

*Attest:*

GERALD J. MOSSINGHOFF

*Attesting Officer*

*Commissioner of Patents and Trademarks*